United States Patent [19]

Tamura et al.

[11] Patent Number: 4,732,057

[45] Date of Patent: Mar. 22, 1988

[54] BOTTLE OPENING MACHINE

[75] Inventors: Kunio Tamura; Takayuki Horiai, both of Yokohama, Japan

[73] Assignee: Kirin Beer Kabushiki Kaisha, Tokyo, Japan

[21] Appl. No.: 829,276

[22] Filed: Feb. 13, 1986

Related U.S. Application Data

[62] Division of Ser. No. 544,878, Oct. 24, 1983, Pat. No. 4,597,314.

[30] Foreign Application Priority Data

Oct. 28, 1982 [JP] Japan ..... 57-189674
Nov. 11, 1982 [JP] Japan ..... 57-198057

[51] Int. Cl.[4] ..... B67B 7/08

[52] U.S. Cl. ..... 81/3.2; 81/3.31; 81/3.39; 198/463.4; 414/411

[58] Field of Search ..... 81/3.2, 3.31, 3.32, 81/54, 3.33, 3.25, 3.27, 3.36–3.39; 53/381 R, 381 A; 198/463.4; 414/411

[56] References Cited

U.S. PATENT DOCUMENTS

| | | | |
|---|---|---|---|
| 2,304,905 | 12/1942 | Gantzer | 198/463.4 |
| 2,324,312 | 7/1943 | Meyer | 198/463.4 |
| 3,237,289 | 3/1966 | Pearson | 81/3.2 |
| 4,044,891 | 8/1977 | Pynsky | 198/463.4 |
| 4,275,980 | 6/1981 | Coots | 414/411 |

*Primary Examiner*—Frderick R. Schmidt

*Assistant Examiner*—Bradley I. Vaught

*Attorney, Agent, or Firm*—Ladas & Parry

[57] ABSTRACT

An improved bottle opening machine for smoothly removing crown caps from bottle necks of empty bottles contained in bottle cases which are being conveyed on a conveyance system in a single file, in which the cap removing is carried out by the steps of engaging of cap removing sections on rotary discs with the crown caps on the bottle necks in an area where the circular movement path of the cap removing sections and the linear movement path of the bottle necks mutually converge in the tangential direction, removing of the crown caps from the bottle necks under the influence of a moment which is produced as the former is separated from the latter as the rotary discs are rotated, and releasing of the removed crown caps from the cap removing sections with the aid of cap releasing mechanisms. To ensure that the cap removing sections are positioned correctly with corresponding bottle necks, at least a synchronizing means is rotatably mounted on the frame structure. The synchronizing means comprises a synchronizing disc disposed adjacent to the rotary discs fixedly mounted on the drum. Alternatively, the synchronizing means may comprise a star wheel adapted to be engaged to the barrel of the bottles. The rotary discs are preferably mounted on a pair of arms adapted to swing upward and downward about pivotal pins on the frame structure.

4 Claims, 15 Drawing Figures

BOTTLE OPENING MACHINE

This is a division of co-pending application Ser. No. 544,878 filed on Oct. 24, 1983, now U.S. Pat. No. 4,597,314.

BACKGROUND OF THE INVENTION

The present invention relates to bottle opening machines for removing crown caps from empty bottles and more particularly to improved bottle opening machines for continuously and automatically removing crown caps from the empty bottles contained in bottle cases which are being conveyed one after another on a conveyance system.

Bottles filled with beer, refreshing drinks, or the like are delivered to consumers, and after consumption of the contents in the bottles, the empty bottles are recovered for bottling beer, refreshing drinks, or the like again. The empty bottles are generally delivered back to a bottling factory in a state wherein they are contained in bottle cases. It is often found that among the recovered empty bottles, some have been manually capped with crown caps, which make it difficult to wash and clean the interior of the respective empty bottles. Thus, there is a necessity for removing such crown caps prior to starting the cleaning operation.

A hitherto known bottle opening machine utilized for the above mentioned purpose is typically so constructed and adapted that cap removing is accomplished by the steps of lowering a pair of pawl means to a position corresponding to the lip portion of the crown cap, causing the pawl means to be actuated until they hold the cap firmly and then forcibly raising up the pawls while the bottle is retained at its shoulder portion so as not to be lifted above the bottle case.

However, it has been pointed out, as drawbacks inherent to this conventional bottle opening machine, that a large power consumption is required for carrying out the intended cap removing operation, that the bottle neck portion is subject to damage during the cap removing operation, and that, because inoperative regions are developed at both the upper and lower dead center points of the raising and lowering movement of the pawl means, continuous and efficient cap removing operation cannot be carried out.

To overcome these problems, we invented an improved bottle opening machine and filed an application (Ser. No. 452,877) for a patent therefor with the U.S. Patent and Trademark Office. The bottle opening machine of the application is provided with a rotary member with a plurality of cap removing sections distributed around the outer periphery thereof, the rotary member being disposed at a position above a roller conveyor on which bottle cases each with a number of empty bottles contained therein are conveyed one after another. In this bottle opening machine, cap removing is carried out continuously by utilizing an increased distance which is developed as the circular movement track of a pawl means in each of the cap removing sections is gradually parted away from the linear movement path of the bottle neck portion of the empty bottles as the bottle cases are conveyed further on the conveyance system.

It should be noted that all of the bottle cases are not always normal and uniform, and sometimes a few bottle cases may have irregularly deformed lateral frames or some foreign material may be on the top or beneath the bottom of the bottles. In the former case, the lateral frame fails to be correctly engaged with synchronizing recesses on the rotary discs or synchronizing discs, resulting in damage of the bottle case or the bottle opening machine itself, while in the latter case, the cap removing sections on the rotary member fail to be correctly engaged onto the bottle necks of the bottles, resulting in damage of the bottle necks or the bottle opening machine itself.

Further, because of the arrangement of the conventional bottle opening machine wherein there is provided a rotary member with the same number of cap removing sections mounted thereon as the number of arrays of bottles contained in the bottle case, it is still necessary that the bottles move through the bottle opening machine even when they are all new bottles which require no cap removing operation. This means that in such as case cap removing is a useless step, and sometimes the existence of the cap removing step inhibits smooth movement of the bottle cases. Another drawback of the conventional bottle opening machine is that some removed crown caps fall incorrectly outside a specific cap receiving basin because the cap removing sections carry them to a predetermined position after their removal from the bottle necks while holding them, and the caps are then discharged therefrom into the receiving basin.

On the other hand, the new bottle opening machine of the aforementioned application is characterized by an arrangement of synchronizing discs or synchronizing guide plates which ensure that the cap removing sections on the rotary discs are correctly engaged with the bottle necks of the bottles contained in the bottle cases which are being conveyed on the conveyancee system.

In the bottle opening machine synchronization is achieved in such a manner that the synchronizing recesses on the synchronizing discs or the synchronizing guide plate come into simultaneous engagement with the rear end (rear lateral frame) of the preceding bottle case and the fore end (fore lateral frame) of the following bottle case. However, a problem arises in that, in the case of bottle cases having a considerably low height, the synchronizing discs or the synchronizing plate fail to be engaged with the lateral frames of the bottle case with the result that the cap removing sections are not correctly engaged with the bottle necks of the bottles, whereby the intended cap removing action is not achieved.

SUMMARY OF THE INVENTION

Accordingly, the present invention is intended to overcome the problems accompanying the conventional bottle opening machine as described above. In view of the above described background with respect to the present invention, it is an object of the invention to provide a bottle opening machine for continuously removing crown caps from bottle necks of bottles in bottle cases at a high operational efficiency without any possibility of causing damage to the bottle necks or the machine itself irrespective of the existence of any irregularly deformed bottle cases among a series of bottle cases conveyed one after another or of any foreign material on top or beneath the bottom of bottles.

It is another object of the invention to provide a bottle opening machine for continuously removing crown caps from bottle necks of bottles in bottle cases in which cap removing sections are correctly engaged with bottle necks in a synchronous relation without any necessity for causing synchronizing recesses on synchronizing discs to be simultaneously engaged with the rear end of the preceding bottle case and the fore end of the following bottle case even when the side walls of the bottle cases have a height less than that of the bottles contained therein.

To accomplish the above objects there is provided according to one aspect of the invention an improved bottle opening machine for removing crown caps from the mouths of empty bottles contained in bottle cases which are being conveyed on a conveyancee system successively in single file, the machine comprising essentially: at least a drum rotatably mounted on a frame structure; a plurality of rotary discs fixedly mounted on said drum, the number of said rotary discs corresponding to the number of file rows of the bottles in each bottle case; a plurality of cap removing sections distributed around the periphery of each of said rotary discs in an equally spaced relation in the peripheral direction, said cap removing sections being so positioned as to correctly register with the positions assumed by the bottle mouths of the bottles in the bottle case, each cap removing section having pawl means adapted to engage the crown caps to be removed; a plurality of synchronizing discs fixedly mounted on the drum adjacent to the rotary discs for ensuring that the cap removing sections are correctly brought into engagement with the bottle mouths of the bottles in the bottle cases as the latter are conveyed on the conveyancee system; cap releasing mechanisms for releasing the crown caps held in the cap removing sections after they have been removed from the bottle mouths; and at least a pair of arms on which the drum is rotatably supported, said arms being adapted to swing about pivotal pins positioned at the one end part thereof, said pivotal pins being supported on brackets fixedly disposed on the frame structure, wherein the cap removing operation is carried out by the steps of engaging the pawl means with the crown caps in an area where the linear movement path of the bottle mouths and the circular movement path of the pawl means are united with one another in the tangential direction, removing the crown caps from the bottle mouths, and finally releasing the same from the cap removing sections, the removing and releasing being effected by a moment which is produced by the increased distance by which the circular movement path is gradually separated from the linear movement path past the aforesaid area as the bottle case is conveyed further on the conveyancee system.

Further, there is provided according to another aspect of the invention an improved bottle opening machine for removing crown caps from bottle mouths of empty bottles contained in bottle cases which are being conveyed on a conveyancee system successively in single file, the bottles having a height higher than that of the surrounding walls of the bottle case, the machine comprising essentially: a drum rotatably mounted on a frame structure; a plurality of rotary discs fixedly mounted on the drum, the number of the rotary discs corresponding to that of file rows of the bottles arranged in each bottle case; a plurality of cap removing sections distributed around the periphery of each of said rotary discs in an equally spaced relation in the peripheral direction, the cap removing sections being so positioned as to correctly register with the positions assumed by the bottle mouths of the bottles in the bottle case, each cap removing section having pawl means adapted to engage the crown caps to be removed; a pair of synchronizing means adapted to engage the barrels of the bottles as the bottle cases are conveyed on the conveyancee system, the synchronizing means being positioned upstream of the drum in the proximity of a side frame of the frame structure; and cap releasing mechanisms for releasing the crown caps held in the cap removing sections after they have been removed from the bottle mouths, wherein the cap removing operation is carried out by the steps of engaging of the pawl means to the crown caps in an area where the linear movement path of the bottle mouths and the circular movement path of the pawl means are united with one another in the tangential direction, removing of the crown caps from the bottle mouths, and finally releasing of the same from the cap removing sections, the removing and releasing steps being effected by a moment which is produced by the increased distance by which the circular movement path is gradually separated from the linear movement path past the aforesaid area as the bottle case is conveyed further on the conveyancee system.

The nature, utility and further features of the present invention will be apparent from the following detailed description with respect to preferred embodiments of the invention when read in conjunction with the accompanying drawings which illustrate the preferred embodiments.

DETAILED DESCRIPTION

Figure 1:
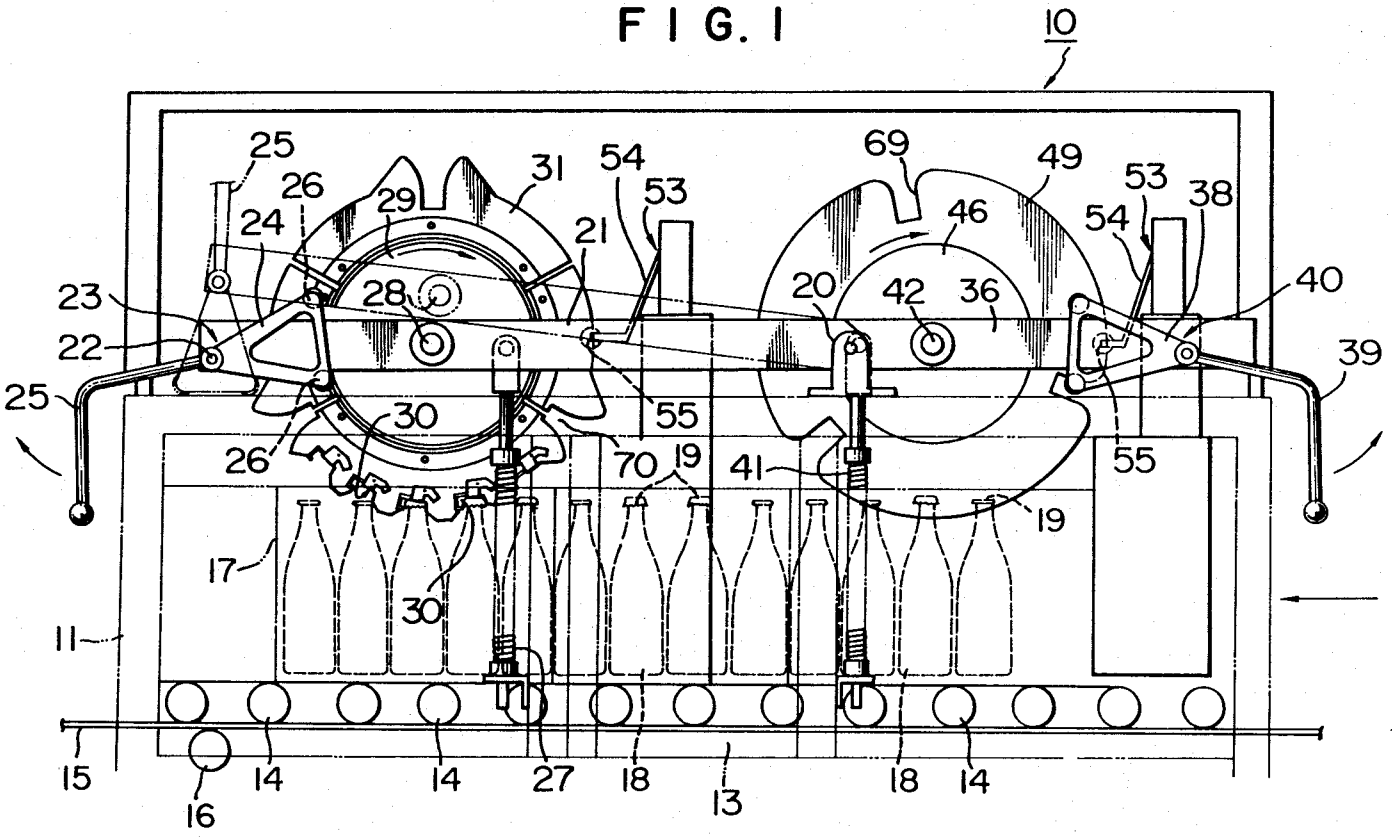
FIG. 1 is a side elevation of a bottle opening machine in accordance with one embodiment of the present invention.
Figure 2:
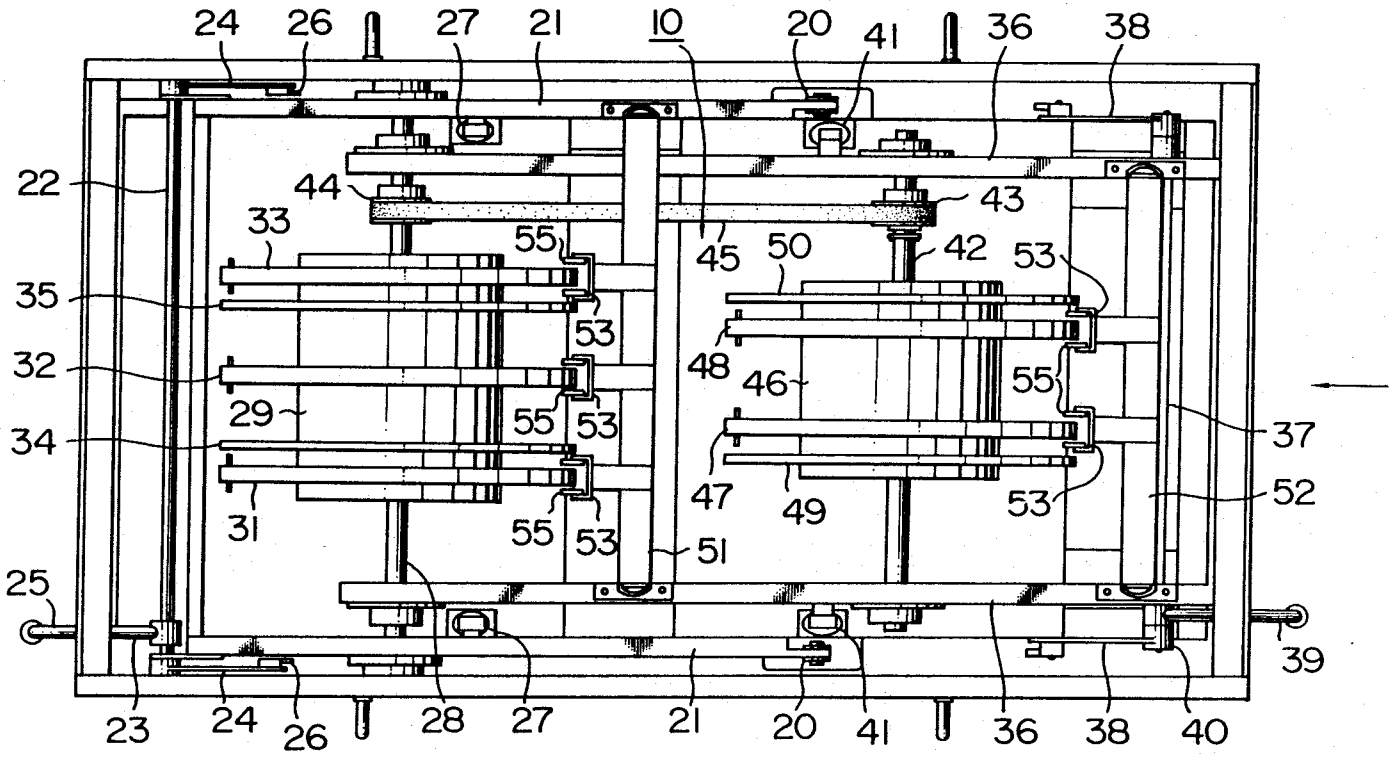
FIG. 2 is a plan view of the bottle opening machine shown in FIG. 1.
Figure 3:
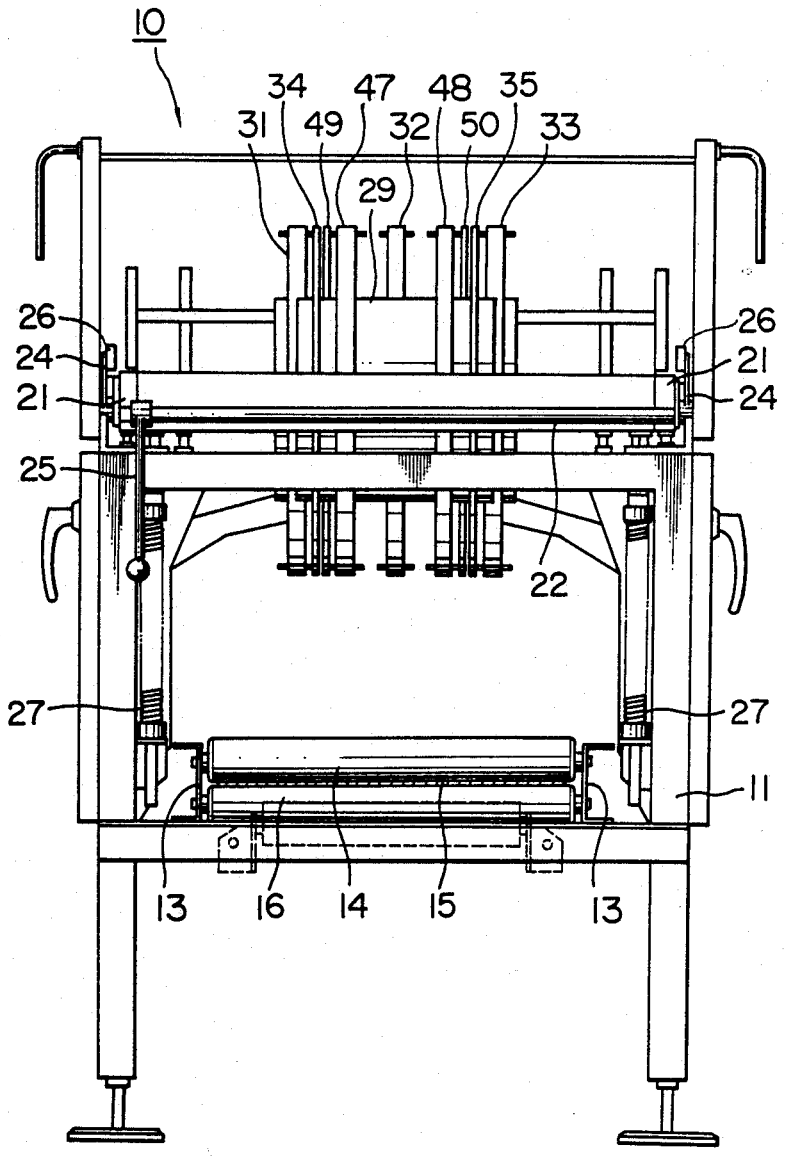
FIG. 3 is an end view of the bottle opening machine in FIG. 1 as viewed in the upstream direction opposite that of the travel of bottles in cases.

Referring first to FIGS. 1, 2, and 3, the bottle opening machine 10 shown therein has a stationary frame 11. Between the front and rear ends of the frame 11 are horizontally extended and supported a pair of support beams 13 between which a number of horizontal rollers 14 are rotatably supported. Below the rollers 14 is provided an endless belt 15 which is pressed into contact with the lower parts of the rollers 14 by pressure rollers 16 which assure increased frictional contact between the rollers 14 and the endless belt 15. As the endless belt 15 is driven, the rollers 14 are caused to rotate, whereby bottle cases 17 placed thereon are conveyed one after another in the arrow direction. The bottle cases 17 each contains a number of empty bottles 18 which have been recovered from consumers who have consumed their contents. In the illustrated example, the bottles 18 contained in each of the bottle cases 17 are arranged, for example, in five file or column rows. It is assumed that some of the bottles 18 are capped with crown caps.

The bottle opening machine 10 has two drums 29 and 46 disposed at rear and front (or downstream and upstream), spaced-apart positions, the axes of these drums being in the transverse direction. On the two sides of the framework 11 are provided respective brackets 20, 20 to each of which the proximal end of a swing arm 21 is pivotally connected. Between the distal end parts of the swing arms 21 is extended a shaft 22 on which a raising and lowering member 23 is provided for raising or lowering the rear drum 29. This raising and lowering member 23 comprises a rotating member 24 and a lever 25, the rotating member 24 having the shape of an isosceles triangle as seen from the side, one of the three apexes of the isosceles triangle being fixedly secured to the shaft 22, the other two apexes rotatably supporting rollers 26,26, respectively.

The raising and lowering member 23 can be manually actuated merely by means of the single lever 25 attached to one end of the shaft 22 as seen in FIG. 16, and there is no lever at the other end of the shaft 22. As the lever 25 is so actuated upward or downward that each rotating member 24 stands upright or lies horizontally, the arms 21 are caused to swing upward or downward about pivotal shafts located at the brackets 20,20 via the rotating member 24 as illustrated by two-dot chain lines in FIG. 1. To facilitate the upward movement of the drum 29, a resilient device 27 (including a coil spring) is disposed between an intermediate part of each arm 21 and the stationary part of the frame 11, the upper end of the resilient device 27 being pivotally connected to the arm 21 while the lower end of the same is anchored at a bracket attached to the side wall of the frame 11 so as to allow it to be inclinable to a certain extent.

Between the two arms 21 is transversely extended a shaft 28 on which the drum 29 is fixedly mounted. As is best seen from FIG. 2, the drum 29 has three rotary discs 31, 32 and 33 mounted thereon in an equally spaced relaiton, and a plurality of cap removing parts 30 are formed on the outer surface of each of the rotary discs 31, 32 and 33. Further, synchronizing discs 34 and 35 are mounted adjacent to and inward of the rotary discs 31 and 33 on the drum 29. The rotary discs and the synchronizing discs are rotated in unison together with the transversely extending shaft 28.

To support the front drum 46, a pair of swing arms 36, 36 are provided to extend horizontally downstream to the sides of the rear drum 29. These arms 36, 36 are parallel to each other and at their downstream ends are pivotally supported on the horizontal shaft 28 so as to be swingable upward and downward about the shaft 28 while their upstream ends rotatably support a transverse shaft 37. At one end of the shaft 37, as seen in FIG. 2, is provided a raising and lowering member 40 which comprises a rotating member 38 and a lever 39, whereas at the other end of the shaft 37 is provided another raising and lowering member 40 which comprises only a rotating member 38. Thus, by manually actuating the lever 39, the arms 36 are caused to swing upward or downward about the shaft 28 via the rotating members 40. Further, to facilitate the upward movement of the drum 46, a resilient device (including a coil spring) is disposed between an intermediate part of each arm 36 and the bracket 20 on the frame 11 so as to urge the arm 36 upward.

At another intermediate part thereof, the arms 36 rotatably support a transverse shaft 42 on which a pulley (or sprocket) 43 is fixedly mounted. On the transverse shaft 28 is fixedly mounted another pulley (or sprocket) 44. An endless belt (or chain) 45 is passed around the two pulleys (or sprockets) 43 and 44 so that the horizontal shafts 28 and 42 are rotated in a synchronous relation. The front drum 46 is fixedly mounted on the horizontal shaft 42 in the same manner as the rear drum 29 and rotary discs 47 and 48 and synchronizing discs 49 and 50 are in turn fixedly mounted on the front drum 46. It should be noted that the rotary discs 31, 32, 33, 47 and 48 are located in correct alignment with the respective file rows of bottles contained in the bottle case 17. Further, it should be noted that the rotary discs 47 and 48 on the front drum 46 are respectively in transverse positions between the rotary discs 31 and 32 and discs 32 and 33 as viewed in the travel direction of the bottles.

Between the two arms 21, 21 is extended a support plate 51 associated with the rear drum 29, while between the two arms 36 is extended another support plate 52 associated with the front drum 46. In the illustrated example, five crown cap releasing mechanisms 53, 35, . . . are fixedly secured to these support plates 51 and 52 at positions corresponding to respective rotary discs 31, 32, 33, 47 and 48. The cap releasing mechanism 53 includes a releasing lever 54 pivotally held about a fulcrum and an engagement roller 55 rotatably supported at the free end of the releasing lever 54 (see FIG. 1).

Figure 4:
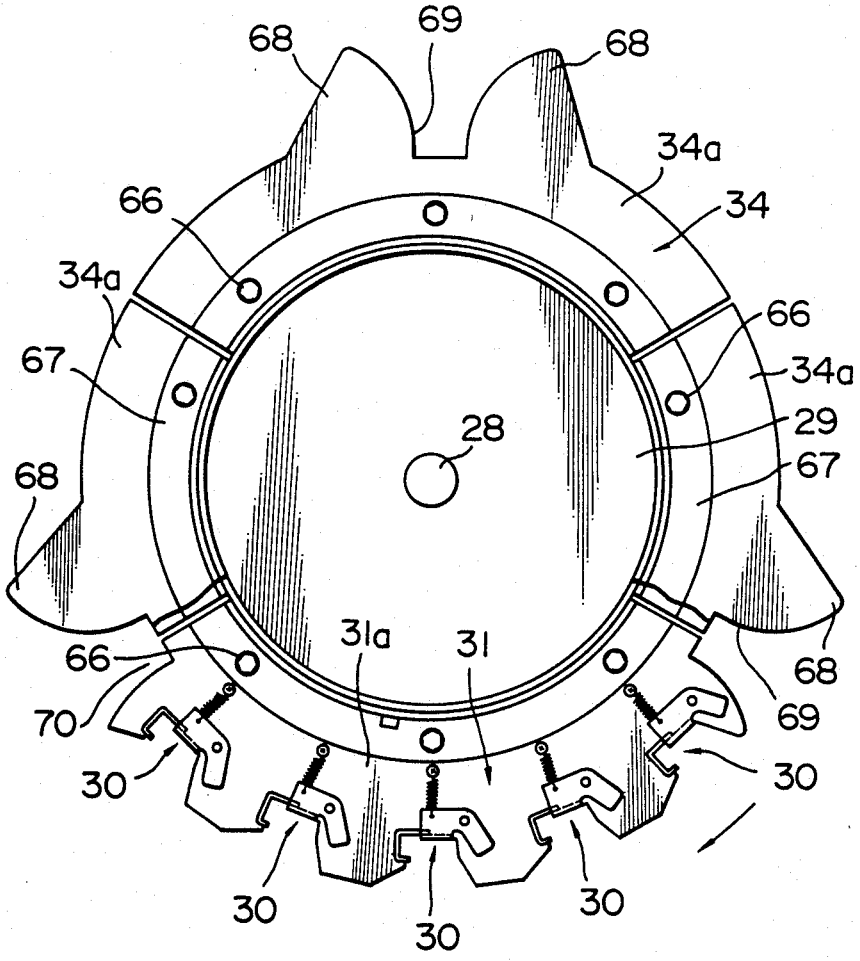
FIG. 4 is a side view of a rotary disc and a synchronizing disc mounted on a drum in the bottle opening machine shown in FIG. 1, wherein the discs are illustrated in a superimposed state.

As is best seen from FIG. 4, each rotary disc comprises a plurality of sector-shaped segments 31*a*, each of which includes the same number of cap removing parts 30 as the number of bottles arranged in each of the file rows in the bottle case 17, the cap removing parts 30 being formed on the outer peripheries of the sector-shaped segments 31*a* in an equally spaced relation. The distance between two adjoining segments is the same as that between the two adjoining bottles in the direction of conveyancee of the bottles 18.

Figure 5:
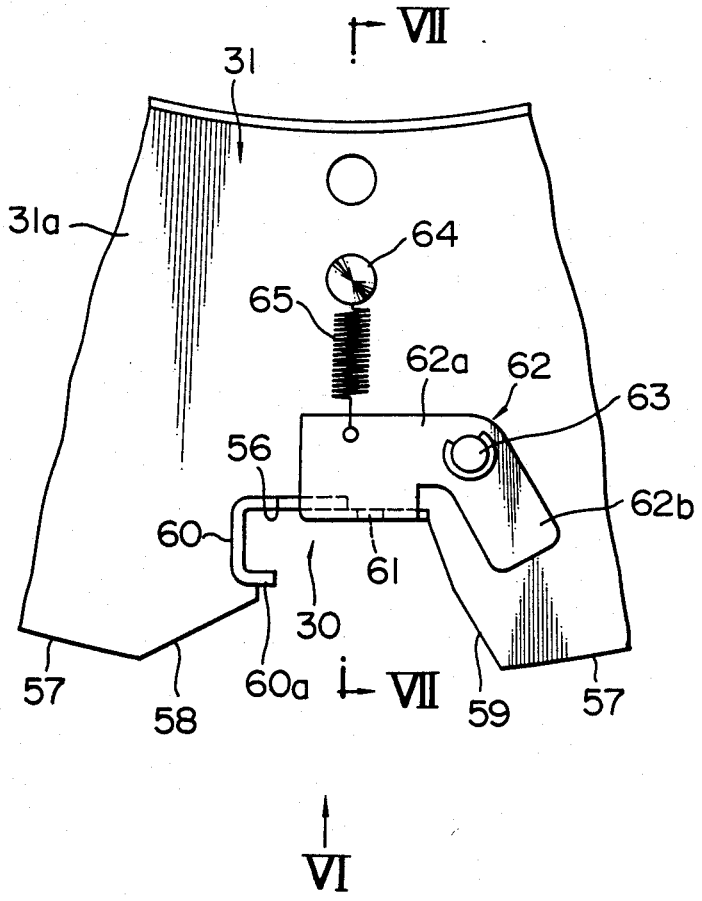
FIG. 5 is an enlarged, fragmentary side view of the cap removing part on the rotary disc in FIG. 4.
Figure 6:
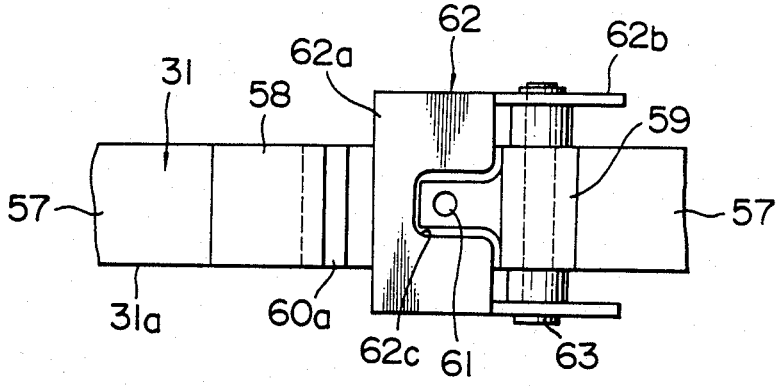
FIG. 6 is a fragmentary view of the cap removing part as viewed in the direction indicated by the arrow VI in FIG. 5.
Figure 7:
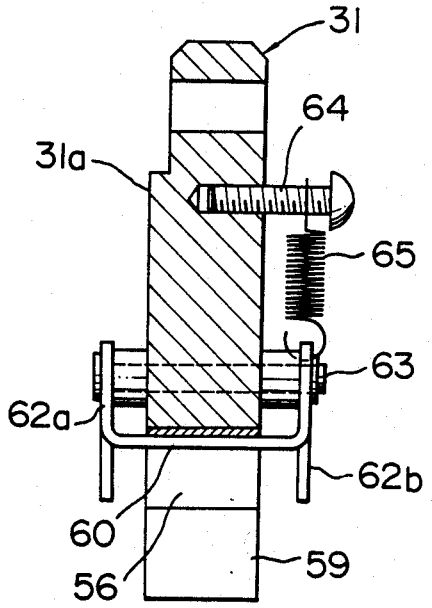
FIG. 7 is a sectional view of the cap removing part, taken along the line VII—VII in FIG. 5 as viewed in the arrow direction.

The detailed structure of the cap removing parts 30 is as illustrated in FIGS. 5 and 6. FIG. 6 is a view seen in the direction indicated by an arrow mark VI and FIG. 7 is a sectional view taken along the line VII—VII in FIG. 5. Specifically, each of a plurality of recesses 56 is formed inward of the outer periphery 57 of each of the sector-shpaed segments 31*a*, and guide faces 58 and 59 extend between the respective recesses 56 and the outer periphery 57 of the segment 31*a*. As is best seen in FIG. 5, a pawl 60 is fitted into a cavity located adjacent to the recess 56 at the left side relative to the latter, while a projection 60*a* constituting a part of the pawl 60 is projected rightward a short distance from the guide face 58.

A permanent magnet 61 is embedded below the recess 56 in the body of the segment 31*a*. Further, a cap releasing member 62 is pivotally disposed on the segment 31*a* as though to bridge over the recess 56. The cap releasing member 62 comprises a combination of a bifurcated portion 62*a* bridging over the recess 56 and arms 62*b* formed integrally with bifurcated portion 62*a* and is supported pivotally about a pin 63 inserted through the segment 31*a* at the boundary position between the bifurcated portion 62*a* and the arm 62*b*. A set screw 64 is screwed into the segment 31*a* as seen in FIG. 5, and a coil spring is stretched between the set screw 64 and the bifurcated portion 62*a* so that the cap releasing member 62 is continually urged in the direction to cause the bifurcated portion 62*a* to be pressed against the recess 56. The permanenL magnet 61 is embedded at a position as illustrated in FIG. 6 within a cutout 62*c* on the bifurcated portion 62*a* which is brought into contact with the recess 56.

As illustrated in FIG. 4, the synchronizing disc 34 is further comprises a plurality of sector-shaped segments 34*a* which are fixed to flange portions 67 on the drum 29 by means of bolts 66 in the same manner as the segments 31*a* of the rotary disc 30. On the outer periphery of one of the segments 34*a* are provided a pair of outwardly projecting portions 68 between which a guide recess 69 is formed. As the drum 29 is rotated, the rear end of the preceding bottle case (rear transverse wall) and the front end of the following bottle case (front transverse wall) are brought into engagement with the guide recess 69 at the same time. Once the above engagement is established, the recesses 56 in the respective cap removing parts 30 are correctly positioned so as to register with the heads of respective bottles 18 contained in the bottle case 17.

Next, the operation of the bottle opening machine in accordance with the above described embodiment of the invention will be described.

The levers 25 and 39 of the raising and lowering members 23 and 40 are normally lowered so that the arms 21 and 36 extend in the horizontal direction. The bottle cases 17 with a lot of bottles 18 contained therein are then placed on the roller conveyor 14. A first case 17 is placed on the conveyor 14 so that the front transverse frame of the first case comes into engagement with one of the guide recesses 69 on the synchronizing discs 49 and 50 when it is fed under the front drum 29. If the next case 17 is placed on the conveyor 14 adjacent to the first case 17, the rear transverse wall of the first case and the front transverse wall of the second case come into engagement with one of the guide recesses 69. Thus, the transverse walls of all cases 17 fed on the conveyor 14 are engaged with the corresponding recesses 69.

As the two abutting transverse walls of the adjoining bottle cases 17 are engaged together with the guide recesses 69 on the synchronizing discs 49 and 50, the latter are caused to rotate as the bottle cases 17 are conveyed on the roller conveyor 14, whereby the front drum 46 and the rotary discs 47 and 48 fixedly mounted thereon are rotated. Since an adjustment is made so that the cap removing parts 30 on the rotary discs 47 and 48 correctly receive the mouths of the bottles 18 in the bottle case 17, the projected part 60*a* of the pawl 60 in each cap removing part 30 is brought into engagement with the lip 19*a* of the crown cap 19 on the mouth or opening rim of the bottle 18 in the front end of an engagement region as illustrated in FIG. 8(*a*) where the linear movement track of the bottle heads of the bottles 18 and the circular movement track of the cap removing parts 30 are united with on another in the tangential relation.

Figure 8:
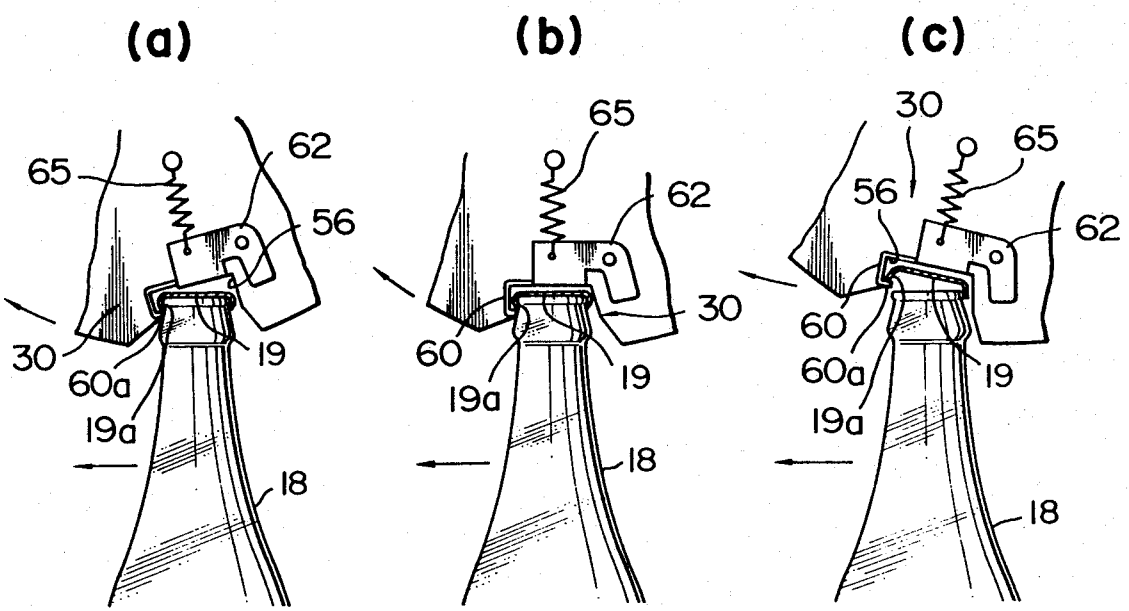
FIGS. 8 (*a*), (*b*) and (*c*) are enlarged partial side views of the bottle opening machine in accordance with the invention indicating the manner in which the cap removing part is brought into engagement with the opening rim of the bottle and then disengaged therefrom with the crown cap removed.

As the bottle case 17 is conveyed further, the crown caps 19 are completely received in the respective recesses 56 of the cap removing parts 30, as illustrated in FIG. 8(*b*). As the bottle case 17 is conveyed still further and moves toward the rear end part of the above mentioned engagement region as illustrated in FIG. 8(*c*), the circular movement track of the cap removing part 30 is parted away from the linear movement track of the mouth of the bottle 18 whereby the crown cap 19 is removed from the opening rim of the bottle 18 and the removed cap 19 is attracted toward the bottom face of the recess 56 by the magnetic force of the permanent magnet 61. It is then transferred while it is held in the recess 56, as the drum 46 is rotated.

Figure 9:
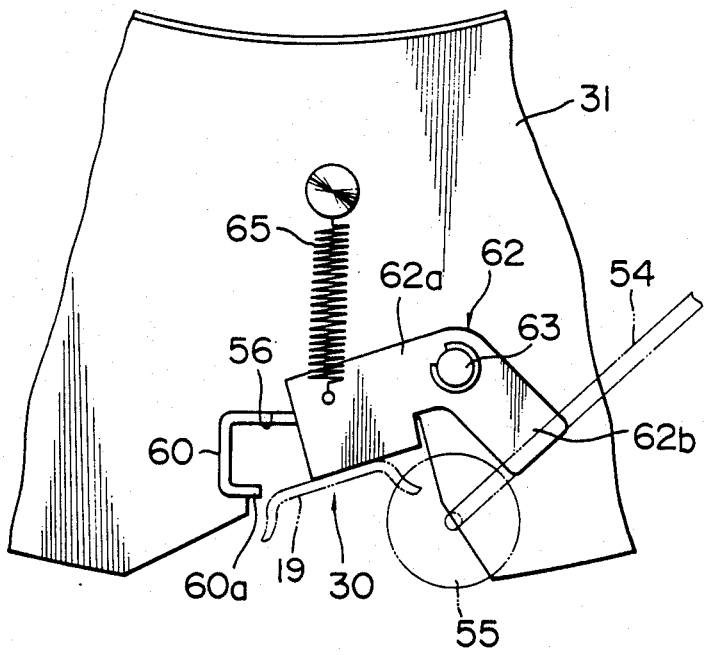
FIG. 9 is an enlarged side view of the cap removing part indicating the manner in which the removed crown cap is released therefrom by a cap releasing mechanism.

When the cap removing part 30 is rotated to the position as illustrated in FIG. 9, where the cap releasing mechanism 53 is operable, the engagement roller 55 at the free end of the cap releasing rod 54 is brought into abutment against the arms 62*b* of the cap releasing member 62 in the cap removing part 30. This causes the arms 62*b* to be rotated in the anticlockwise direction as seen in the drawing, whereby the crown cap 19 held by the permanent magnet 61 is released from the interior of the recess 56 on the cap removing part 30 by the bifurcated portion 62*a* of the cap releasing member 62. The cap 19 is then discharged into a cap receiving basin (not shown) located beneath the cap releasing mechanism 53.

As will be readily understood from the above description, the crown caps 19 on the bottle opening rims or mouths of the bottles 23 arranged in the second and fourth files in the bottle case 20 are successively removed by the cap removing parts 30 on the rotary discs 47 and 48. Owing to the structure of the cap removing parts as described above, positive holding and releasing of the removed crown caps are carried out reliably, and the cap releasing mechanism is almost completely free of trouble because of its simple function.

As the bottle case 17 is conveyed further, the guide recesses 69 on the synchronizing discs 34 and 35 fixedly mounted on the rear drum 29 are brought into engagement with the rear transverse wall of the preceding bottle case and the front transverse wall of the following bottle case. At the same time, both transverse walls are joined to one another in an end-to-end relation, whereby the crown caps 24 on the bottles 23 arranged in the first, third and fifth files in the bottle case are removed from their respective bottle opening rims in exactly the same manner as described hereinabove.

Figure 10:
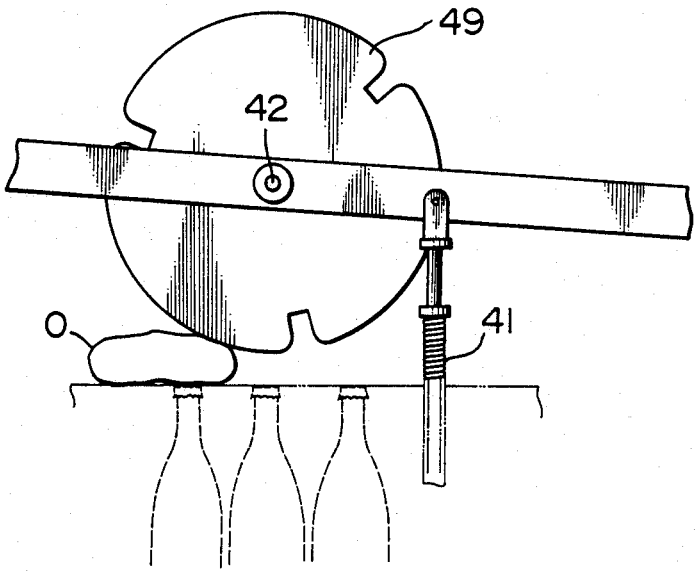
FIG. 10 is a side view of the synchronizing disc rotatably mounted on a swing arm in accordance with a modified embodiment of the invention indicating the manner in which the arm is raised when a foreign material is on the opening rim of a bottle.

As described above, all of the crown caps 24 on the bottles 23 in the bottle case 20 are removed therefrom by operating the bottle opening machine. If any foreign material or obstacle O such as a stone or the like is inadvertently placed on the head portion of the bottle 23 in the bottle case 20 for some reason as illustrated in FIG. 10, it abuts against the peripheral part of the rotary discs or the synchronizing discs as the bottle case is conveyed through the bottle opening machine. This causes an upwardly directed force to be exerted on the rotary discs or the synchronizing discs, which force is transmitted to the arms 36 via the shaft 42. As a result the arms 36 swing upward about the shaft 28 of the rear drum 29, which serves as a fulcrum, so that the whole front drum 46 is raised. Thus, the obstacle O is prevented from entering the space between the rotary disc and the synchronizing disc or the guide recess on the synchronizing disc. Therefore, there is no risk of damaging or chipping the bottles and machine parts. Since the drum 46 is normally urged upward by the resilient devices 41, the upward swinging movement of the drum 46 is assisted thereby and takes place rapidly. The drum is restored to its original position after the obstacle passes by.

If any obstacle is present on a bottle 18 in any one of the first, third and fifth files in the bottle case 17, it abuts against one of the rotary discs 31, 32 and 33 or the synchronizing discs 34 and 35 on the rear drum 29, whereupon the arms 21 are caused to swing upward about the pivotal shaft on the brackets 20 assisted by the resilient devices 27 in the same manner as in the foregoing. As described above, the two drums 29 and 46 are raised independently in response to abutment against the rotary discs or the synchronizing discs of an obstacle on the bottle or a deformed transverse wall of the bottle case.

The bottle opening machine is ordinarily installed in a bottle processing line, and the crown cap removing operation is not therefore required, for instance, when new bottles pass therethrough. In such a case both drums are held at a raised position by turning up the handles 25 and 29 of the raising and lowering members 23 and 40, whereby the new bottles move smoothly through the bottle opening machine without any hindrance or waste motion imparted to the processing line. In this example, as two drums are separately disposed at the front and rear parts of the bottle opening machine, and rotary discs are mounted on them in such a manner as to alternately correspond to the plural files of bottles in a bottle case, the crown cap removing operation is carried out with high efficiency, because only one of the drums which has rotary discs corresponding to an obstacle is required to be raised when the obstacle abuts against one of the rotary discs and the other drum can continue the cap removing operation.

Since the drums 46 and 29 are operatively coupled to each other by the endless belt or chain 45, the synchronizing discs are not necessarily required to be mounted on both of them and may be mounted on only the front drum 46. Alternatively, clearances or slots 70 between the oppositely located end parts of the adjacent sector-shaped segments constituting a rotary disc may be substituted for assuming the function of the synchronizing disc (see FIG. 4). In this case the slots 70 are located and dimensioned to be correctly engaged with transverse walls of two joined bottle cases so that they function as synchronizing means. Further, the drum raising and lowering mechanism of the type as shown in the drawings is merely illustrative, and the present invention should not be limited to only the illustrated example. Alternatively, the raising and lowering mechanism may be so constructed that the front drum 46 has only synchronizing discs mounted thereon, and the rear drum 29 has both rotary discs and synchronizing discs mounted thereon. Further, another type of synchronizing mechanism may be mounted on the front drum.

Figure 11:
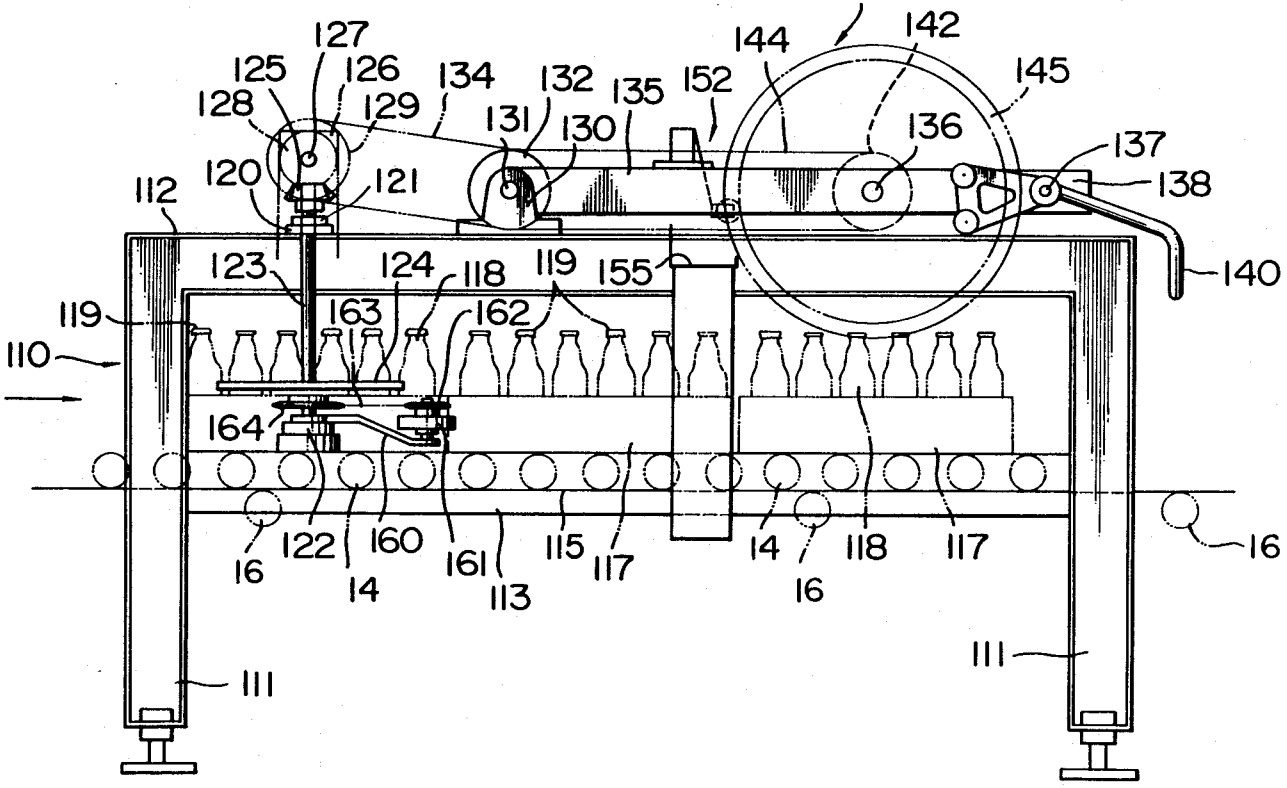
FIG. 11 is a side view of the entire bottle opening machine in accordance with another modified embodiment of the present invention.
Figure 12:
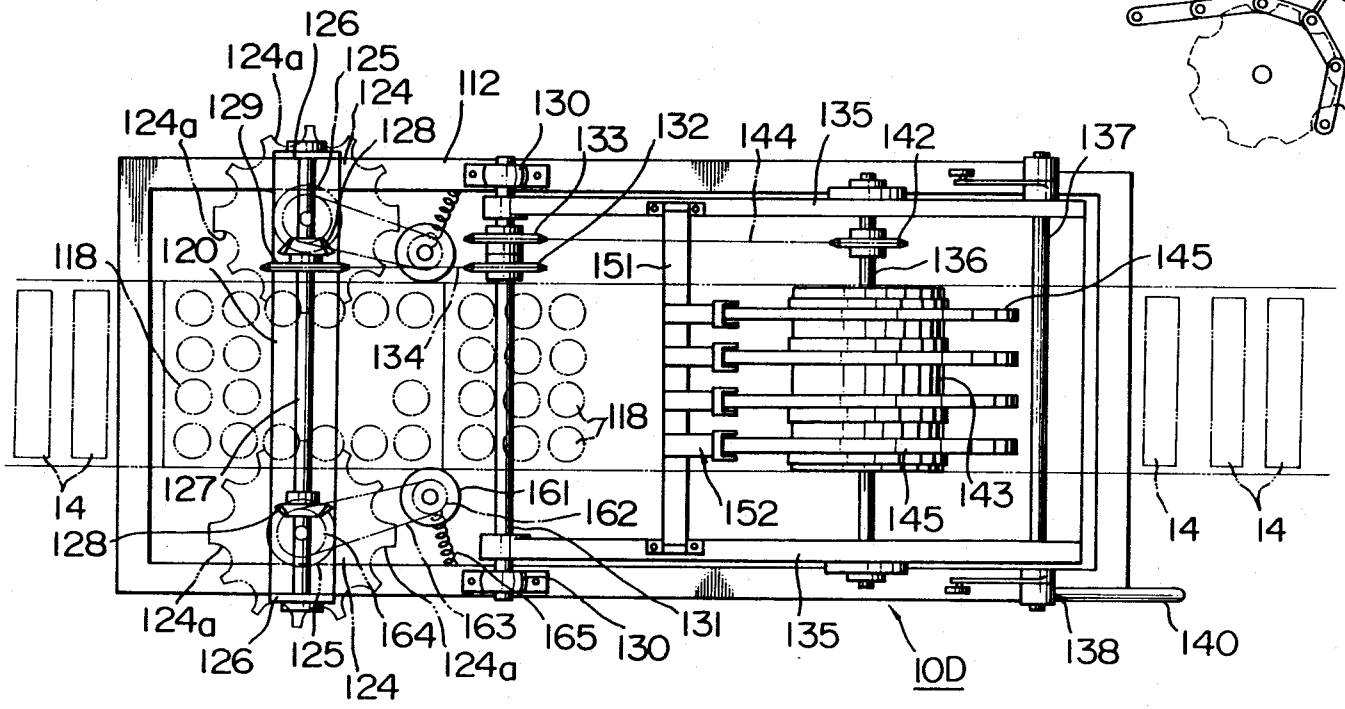
FIG. 12 is a plan view of the bottle opening machine shown in FIG. 11.

Finally, FIGS. 11 and 12 illustrate the fourth modified embodiment of the present invention which is intended to ensure reliable synchronization particularly when bottles in bottle cases of lower height are to be processed.

Referring to FIGS. 11 and 12, the bottle opening machine 10D includes a stationary framework 110 which comprises a combination of four vertical members 111 and a rectangular upper frame 112 fixedly mounted on the top ends of the vertical members 111. Further, parallel support beams 113 extend across the front and rear vertical members 111 in the longitudinal direction, and a roller conveyor 14 is provided between the pair of support beams 113. The roller conveyor 14 serves to convey bottle cases 117 each of reduced height in which a number of empty bottles 118 such as beer bottles, soft drink bottles or the like are contained, each of these bottles having a height higher than that of the side walls of the recovered bottle case. In the illustrated example, four files (rows) of empty bottles, each of which consists of six bottles, are contained in each of the bottle cases 117. Among the empty bottles contained in the bottle case, some are capped with crown caps 119.

Further, a support plate 120 extends transversely across the upper frame 112 on the stationary framework 110, and bearing means 121 are disposed at the two end parts of the support plate 120. Under the respective bearing means 121 and on the respective support plates 113 are respectively disposed bearing means 122 by which vertical shafts 123 are rotatably held by the bearing means 121 and 122. On the lower end part of each vertical shaft 123 is fixedly mounted a star wheel 124 which has a plurality of semicircular recesses **124*a* formed around the periphery thereof, the recesses 124*a* being adapted to engage the barrels of respective bottles 118. An auxiliary synchronizing roller 161 is provided in operative association with each star wheel 124 and is rotatably held at the free end of an arm 160 adapted to swing horizontally about the shaft 123. Each roller 161 has a sprocket 162 disposed thereabove, the sprocket 162 being operatively connected to a sprocket 164 on the shaft 123 via an endless chain 163. Further, each roller 161 is normally urged so that it contacts the side wall of the bottle case 117 under a biasing force imparted by a coil spring 165. When each star wheel 124 fails to be rotated because of absence of bottles in the bottle case 117, each roller 161 functions as an auxiliary synchronizing means which allows the shaft 123 to continue its rotation. It should be noted that each roller 161 is dimensioned so as to rotate through one revolution for each bottle case, while the star wheel 124 is dimensioned so as to rotate through one revolution per two bottle cases. A bevel gear 125 is fixedly mounted on each vertical shaft 123 at the top end part above the bearing means 121**.

At the two end parts of the support plate 120 are disposed brackets 126 through which a shaft 127 is horizontally extended so as to rotate freely. On the shaft 127 are fixedly mounted bevel gears 128 and a sprocket 129. The bevel gears 128 are meshed with the bevel gears 125 on the vertical shaft 123.

On the other hand, on the right side of each star wheel 124 (as viewed in FIG. 12) is disposed bearing means 130 which is fixedly mounted on the upper frame 112 of the stationary framework 110. A shaft 131 is horizontally extended across and through the two bearing means 130 and carries sprockets 132 and 133 thereon. An endless chain 134 is passed around both the sprockets 129 and 132.

A pair of arms 135 are pivotably fitted onto the two end parts of the shaft 131 at their pivotal ends so that they can swing upward and downward. Further, a rotating shaft 136 extends across the pair of arms 135, while a rotating shaft 137 extends across the arms at the free end parts thereof. A raising and lowering member 138 for raising up or lowering the arms 135 is attached to the shaft 137 at the two end parts. The structure and function of this raising and lowering member 138 are same as those of the raising and lowering member 40 in the preceding example, and therefore description thereof will not be repeated.

A sprocket 142 and a drum 143 are fixedly mounted on the shaft 136. An endless chain 144 is passed around the sprocket 133 on the shaft 131 and the sprocket 142 on the shaft 136 and four rotary discs 145 are mounted on the outer surface of the drum 143. Further, a plurality of cap removing parts are formed around the periphery of each of the rotary discs 145 in an equally spaced relation as illustrated in FIG. 4.

Another transverse support plate 151 is fixed at its two ends respectively to the arms 135 at a position where there is no possibility of interference with the rotary discs 145. Four cap releasing mechanisms 152 constructed in the same manner as the cap releasing mechanisms 53 in the preceding embodiment of the invention are mounted on the support plate 151 and operate to release crown caps 119 held on the rotary discs 145 and then to discharge the same into a cap receiving basin 155.

The number of teeth of the bevel gears 125 and 128 as well as the number of teeth of the sprockets 129 and 132 are so determined that the peripheral speed of each star wheel 124 is the same as that of the rotary discs 145.

The operation of the bottle opening machine as described above and illustrated in FIGS. 11 and 12 will now be described.

As the bottle cases 117 are conveyed on the roller conveyor 14 in the direction indicated by an arrow mark in the drawings, the barrels of the bottles 118 in the outermost files in each bottle case 117 are engaged with respective semicircular recesses 124*a* of the star wheels 124. The star wheels 124 are caused to rotate as the bottles 118 move further, and their respective rotations are then transmitted to the shafts 136 via the transmission mechanisms comprising the shaft 123, the bevel gears 125 and 128, the sprockets 129, 132, 133 and 142 and other parts, whereby the rotary discs 145 are rotated at the same peripheral speed as that of the star wheels 124. When there is an empty space in the bottle case 117 due to absence of a bottle, the auxiliary synchronizing rollers 261 function to rotate each shaft 123 because they continually contact the side walls of the bottle case 117 as the cases are conveyed.

The cap removing parts are disposed along the periphery of the rotary discs 145 at the same spacing distance as that between the adjacent bottles 118 contained in the bottle case 117, and the circular movement path of the cap removing parts and the linear movement path of the bottle heads of the bottles 118 converge in tangential relation relative to the rotary discs 145. Thus, cap removing is carried out by way of steps as illustrated in FIG. 8. In this modified embodiment of the invention, synchronization between the conveyed bottle cases and the cap removing parts is assured by means of synchronizing mechanisms adapted to come into contact with the barrels of the bottles or the side walls of the bottle cases. As a result, reliable synchronization is achieved in spite of the fact that the bottles are contained in bottle cases of low height.

In the case where all of the bottles 118 in the bottle cases 117 are not capped with crown caps, engagement of the bottle heads with the cap removing parts is not only useless but sometimes may cause a hindrance to smooth conveyancee of the bottle case 117. In such a case, therefore, the drum 143 is held at a raised position by operating the lever 140 of the raising and lowering member 138.

In case where the drum 143 is heavy and the arms 135 and 136 cannot swing fully, the same resilient devices as shown in the above example may be provided in order to assist upward swing of the arms 135 and 136.

Figure 13:
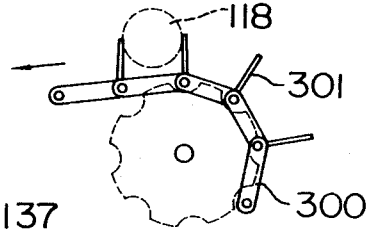
FIG. 13 is a schematic side view of a synchronizing mechanism constructed in accordance with the modified embodiment of the present invention shown in FIG. 11.

As a modification from the preceding embodiments of the invention, an endless moving guide such as an endless chain 300 having guide vanes 301 secured to the joint portions thereof so as to cause each bottle 118 to be supported in the space defined between the adjacent vanes 301 as illustrated in FIG. 13 may be employed instead of the star wheels 124.

While the present invention has been described above with respect to the illustrated embodiments, it should be of course understood that the invention is not limited only thereto, and that various changes or modifications may be made therein without any departure from the spirit and scope of the invention.

What is claimed is:

1. A bottle opening machine for removing crown caps from the mouths of empty bottles contained in bottle cases which are being conveyed on a conveyancee system successively in a single file, said bottle opening machine comprising at least one drum rotatably mounted on a frame structure;

a plurality of rotary discs fixedly mounted on said drum, the number of said rotary discs corresponding to that of file rows of the bottles in each bottle case;

a plurality of cap removing sections distributed around the periphery of each of said rotary discs in an equally spaced relation in the peripheral direction, said cap removing sections being so positioned as to correctly register with the positions assumed by the bottle mouths of the bottles in the bottle case, each cap removing section having pawl means adapted to engage the crown caps to be removed;

synchronizing means for ensuring that the respective cap removing sections are correctly brought into engagement with the bottle mouths of the bottles in the bottle cases as the latter are conveyed on the conveyancee system;

cap releasing mechanisms for releasing the crown caps held in the cap removing sections after they have been removed from the bottle mouths;

at least a pair of arms on which the drum is rotatably supported, said arms being adapted to swing about pivotal pins positioned at one end part thereof, said pivotal pins being supported on brackets fixedly disposed on the frame structure, the cap removing operation comprising engagement of said pawl means with the crown caps in an area where the linear movement path of the bottle mouths and the circular movement path of the pawl means are united with one another in the tangential direction, subsequent removal of the crown caps from the bottle mouths, and final release of the same from the cap removing sections, said removal and release being effected by a moment which is produced by the increased distance by which the circular movement path is separated from the linear movement path past the aforesaid area as the bottle case is conveyed further on the conveyancee system; and said synchronizing means comprises a star wheel adapted to engage the barrels of the bottles, and an auxiliary synchronizing roller adapted to come in contact with the wall surface of the side frame is provided in addition to said star wheel, said auxiliary synchronizing roller being in operative association with the star wheel, said synchronizing means is adapted to engage the barrels of the bottles as the bottle cases are conveyed on the conveyancee system, said synchronizing means being positioned upstream of the drum in the proximity of side frame of the frame structure.

2. A bottle opening machine as claimed in claim 1, wherein the auxially synchronizing roller is urged toward the side wall of a bottle case and is connected to the star wheel via a chain so that rotation of the roller is transmitted to the star wheel.

3. A bottle opening machine as claimed in claim 1, wherein rotation of the star wheel is adapted to be transmitted to the drum rotatably mounted on a frame structure via transmitting means.

4. A bottle opening machine as claimed in claim 1, wherein the pair of arms has a raising and lowering member secured to the free ends of the arms so as to be raised above the frame structure.

* * * * *